US007318526B2

(12) United States Patent
Seelye et al.

(10) Patent No.: US 7,318,526 B2
(45) Date of Patent: Jan. 15, 2008

(54) OVERHANG EDGE SHIPPING PROTECTOR

(75) Inventors: Scott J. Seelye, Corvallis, OR (US); Richard B. Hurley, Corvallis, OR (US); Richard D. Hurley, Corvallis, OR (US); Melvin K. Kelsey, Corvallis, OR (US); Randy A. Laws, Lenoir, NC (US); Mark W. Betts, Corvallis, OR (US)

(73) Assignee: Western Pulp Products Company, Corvallis, OR (US)

( * ) Notice: Subject to any disclaimer, the term of this patent is extended or adjusted under 35 U.S.C. 154(b) by 427 days.

(21) Appl. No.: 10/884,513

(22) Filed: Jul. 1, 2004

(65) Prior Publication Data

US 2006/0000745 A1 Jan. 5, 2006

(51) Int. Cl.
*B65D 85/30* (2006.01)

(52) U.S. Cl. ..... 206/586; 206/453; 52/287.1

(58) Field of Classification Search ..... 206/453, 206/586; 52/287.1; 40/778
See application file for complete search history.

(56) References Cited

U.S. PATENT DOCUMENTS

| | | | | |
|---|---|---|---|---|
| 2,507,929 | A * | 5/1950 | Pennebaker | 206/586 |
| 2,560,249 | A | 7/1951 | Risch | |
| 2,878,982 | A * | 3/1959 | Gariepy | 206/586 |
| 3,041,775 | A | 7/1962 | Brown, Jr. et al. | |
| 3,137,087 | A | 6/1964 | Shroyer | |
| 3,762,626 | A | 10/1973 | Dorsey | |
| 4,120,441 | A | 10/1978 | Hurley | |
| 4,742,916 | A | 5/1988 | Galea | |
| 4,838,427 | A | 6/1989 | Hurley | |
| 5,040,684 | A * | 8/1991 | Knowles | 206/586 |
| 5,065,972 | A * | 11/1991 | Buckshaw et al. | 248/345.1 |
| 5,678,692 | A | 10/1997 | Gratz | |
| 5,772,037 | A | 6/1998 | Hurley | |
| 5,816,409 | A | 10/1998 | Baker et al. | |
| 6,470,637 | B2 | 10/2002 | Gratz | |
| 6,520,337 | B2 | 2/2003 | Smith | |
| 6,629,608 | B2 | 10/2003 | Hurley et al. | |
| 6,840,372 | B2 * | 1/2005 | Giles et al. | 206/216 |
| 6,881,469 | B2 * | 4/2005 | Hightower | 428/99 |
| 2005/0150810 | A1 * | 7/2005 | Durrant | 206/586 |

* cited by examiner

*Primary Examiner*—Jila M Mohandesi
(74) *Attorney, Agent, or Firm*—Schwabe, Williamson & Wyatt, P.C.

(57) ABSTRACT

An overhang edge shipping protector is provided that may allow for enhanced protection of an overhang edge during shipping of an item having an overhang edge. The overhang edge shipping protector may include an overhang cavity, one or more side lands and a buttress, all of which may be capable of absorbing and transferring energy from an adverse impact force to more suitable and sturdy locations of the item, such as the sides.

26 Claims, 2 Drawing Sheets

OVERHANG EDGE SHIPPING PROTECTOR

FIELD OF THE INVENTION

Embodiments in accordance with the present invention relate to protective cushioning devices applied to corners and edges of a wide variety of items having an overhang, offset, or reveal edge (hereinafter referred to as an overhang edge), including, but not limited to, occasional tables, furniture casegoods, shelving and the like, which are typically packed in cartons, shrink-wrapped, or otherwise secured for shipping.

BACKGROUND OF THE INVENTION

Shipping containers holding articles such as occasional tables, furniture casegoods, shelving, aquatic tank stands, and other furniture (bedroom, dining room, etc.) may be handled several times between the manufacturer and the end user. These items are stacked, stored, and transferred by individuals oftentimes using mechanized equipment and other devices. During this process, many of the items may be subject to impacts and other forces that can damage the item rendering it not merchantable and/or less than in new condition. The edges and corners of the item are typically the points that receive the bulk of adverse impacts that may be encountered during transit and are the most susceptible to damage.

To resist such damage, corner and edge protectors, such as those disclosed in U.S. Pat. No. 6,629,608, may be used to protect the corners and edges of the items from damage as a result of forces encountered during transit. Known corner and edge protectors are relatively effective in reducing the damage to items, such as cabinetry, that have generally defined corners and edges that are substantially equalangular, such as a 90° cube-like corner.

Certain types of occasional tables, furniture casegoods, and the like, however, may have a more complex corner geometry, and often include an overhang edge that can protrude outward and beyond the plane of the item sides. These overhang edges are particularly vulnerable to damage, as the protruding edges are most often the point of impact for adverse forces encountered during transit. For example, if a dresser having an overhang edge is dropped, it is likely that the protruding overhang edge (in particular the overhang edge corner) may make first contact with the ground. This may not only result in direct damage to the overhang edge, which is a particular problem when dealing with fragile veneered edges, but may also cause the surface to which the overhang edge is a part to weaken in connection with the rest of the dresser.

Accordingly, an improved shipping protector is needed that can better protect the overhang edges of items from adverse forces that may be encountered during shipping between the manufacturer and the end user.

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

DETAILED DESCRIPTION OF EMBODIMENTS OF THE INVENTION

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Embodiments of the present invention include shipping protectors used to protect items such as occasional tables, furniture casegoods, dressers, nightstands, shelving, items having crown molded edges, and other items from damage where the item has an overhang or reveal edge, which may be at least one surface that overhangs one or more adjacent surfaces to the overhanging surface. One such example is in a coffee table where the edge of the top surface overhangs the coffee table legs and/or side skirt.

Embodiments of the present invention may allow for a molded fiber shipping protector that has an overhang cavity configured to encompass an overhang edge having a variety of profiles, and which may be coupled to larger side lands that may be adapted for engagement with the side surfaces of the item (e.g., table legs). So configured, energy resulting from an adverse force directed to the overhang edge may be transferred from the overhang cavity to the side lands and thus may be dissipated and/or distributed to a larger side surface of the item.

Embodiments of the present invention may include an elongated buttress or a like-molded fiber structure that may extend from the overhang cavity in a direction away from the overhang edge, to better facilitate transfer of energy from the overhang cavity to side lands coupled to the elongated buttress. The elongated buttress may also act in conjunction with the top surface of the shipping protector to ensure proper alignment within a shipping carton, such as a corrugated box.

Embodiments of the present invention also may include a shipping protector having larger side lands configured to create a standoff distance between the interior portion of the overhang cavity and the surfaces of the overhang edge, and in particular the upper and lower edges, such that a majority of the overhang edge and the upper and lower edges of the overhang edge is not in prolonged contact with any portion of the overhang cavity. This may be referred to as a floating edge, and though certain points of the overhang edge may contact the interior surface of the overhang cavity at different times depending on container loading and exerted forces, the floating edge helps resist burnishing and/or abrading of the edges and surfaces of the overhang edge.

Figure 1:
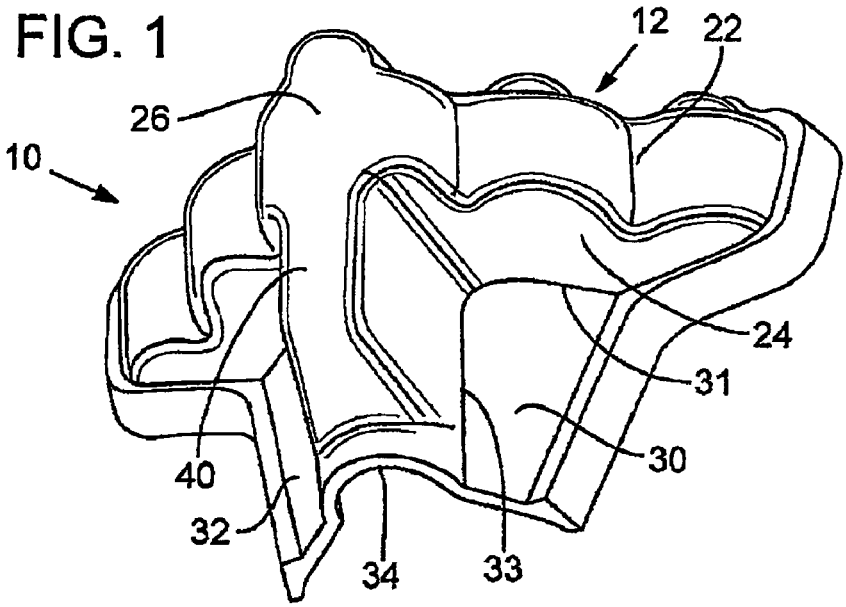
FIG. 1 illustrates a plan view of an overhang edge corner protector in accordance with an embodiment of the present invention.
Figure 2:
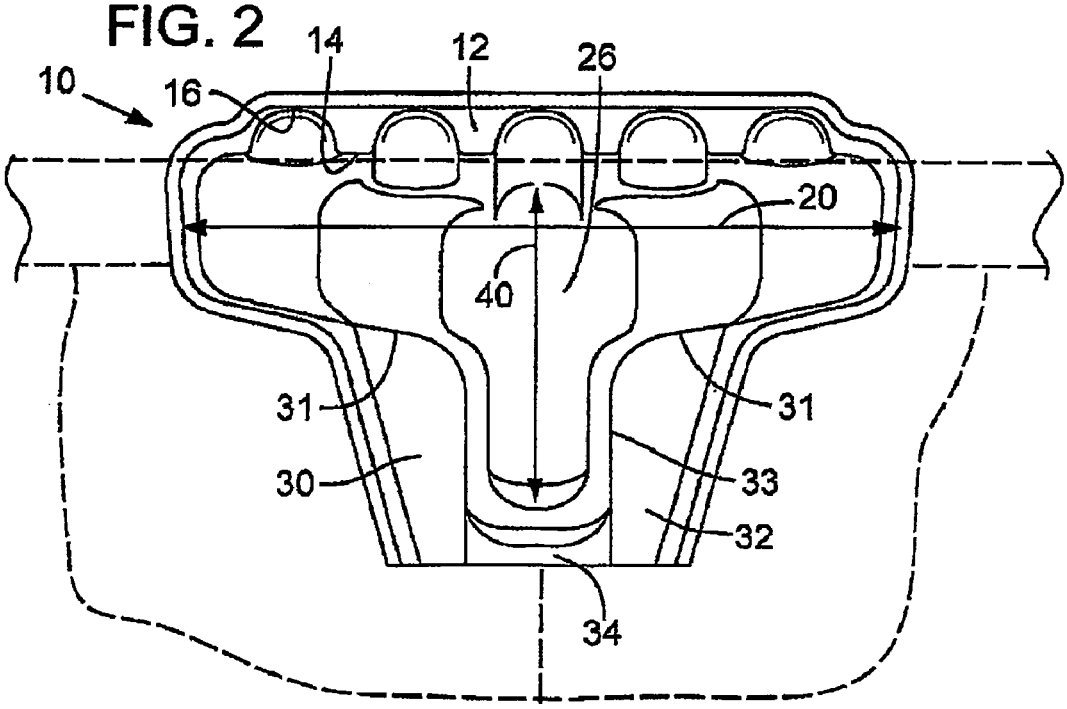
FIG. 2 illustrates an end view of an overhang edge corner protector in accordance with an embodiment of the present invention.

FIG. 1 illustrates a perspective view of an overhang edge corner protector in accordance with an embodiment of the present invention. FIG. 2 illustrates an end view of the overhang edge corner protector of FIG. 1 in accordance with an embodiment of the present invention. Overhang edge corner protector 10 may be made of a molded fiber material and may include a top surface 12 having a plurality of lands 14 and valleys 16 designed to absorb shock and certain impact forces. Embodiments of the present invention may include a variety of land and valley configurations that may be used for impact absorption, depending on, for example, the material used for the shipping protector, the nature and types of forces encountered during shipping, cost, manufacturing constraints, and the like. U.S. Pat. Nos. 6,629,608 and 5,816,409, for example, illustrate different types and configurations of land and valley arrangements.

Overhang edge corner protector 10 may also include an overhang cavity 20. Overhang cavity 20 may be defined generally by top surface 12, rear wall 22 and an overhang cavity floor 24. Rear wall 22 may be undulated along its length to increase the impact absorption capability of the overhang edge corner protector 10, and also to help resist splitting forces that may be encountered due to contact with an edge. In the case of the overhang edge corner protector 10, the undulations of rear wall 22 may meet at an outward undulation, creating a bulbous corner 26. Bulbous corner 26 may thereby define an area in which the corner of an overhang edge may be positioned. As with the undulations in the rear wall 22, bulbous corner 26 may be stronger than that of a typical square-type corner and may better absorb and dissipate energy away from the overhang edge corner as opposed to transferring such energy directly to the overhang edge. It can be appreciated, however, that the undulations in rear wall 22 and the bulbous aspect of corner 26 are not required.

Shipping protector 10 may also include first and second side lands 30, 32. First and second side lands 30, 32 may be angularly opposed to each other and integrated with the floor 24 of overhang cavity 20 at transition point 31. First and second side lands 30, 32 may extend away from the overhang cavity 20, and have a larger lateral surface area that may be configured for engagement with a correspondingly large surface area of the side surfaces of an item being protected. Some or all of surface area of the first and second side lands 30, 32 may be in contact with a respective side of an item at any given time.

The first and second side lands 30, 32 may be joined at a corner by an outward protrusion 34. Outward protrusion 34 may allow for the vertical edge of an item that extends away from the overhang edge to be generally floating, or not in constant contact with the overhang edge corner protector 10, again to help prevent abrading. Outward protrusion 34 may also provide additional shock absorption value and facilitate transfer of energy to the side lands 30, 32.

First and second side lands 30, 32 may be larger broader surfaces that are adapted to engage a larger area of a side surface of an item being protected. In one embodiment of the present invention, the side lands may be adapted for contact with a relatively large area of the item's sides, such that energy transferred from the overhang cavity 20, which could normally be transferred to the overhang edge itself, may be distributed over a larger area of the item's sides (typically a structurally more sturdy part of the item).

The first and second side lands 30, 32 may be sized, however, based on a number of factors, including but not limited to the depth of the overhang edge, the thickness of the overhang edge, the size of the items sides, customer specifications, item composition, delicacy of the finish applied to the item, strength of the outer shipping container, and the like.

In one embodiment of the present invention, a buttress 40 may be integrated with the bulbous corner 26 of overhang cavity 20 and may extend downwardly away from the overhang cavity 20. Buttress 40 may protrude outwardly a similar distance as bulbous corner 26, and may create an additional void in which the downwardly projecting edge of the item's side surfaces may be floatingly encompassed. Buttress 40 may be elongated and serve to absorb and/or transfer energy away from the overhang cavity 20, and thus away from the overhang edge. This energy may be transferred towards the first and second side lands 30, 32, which again may blunt the impact forces by dissipating the energy into a broader portion of the item's first side and item's second side.

In one embodiment of the present invention, including bulbous corner 26, buttress 40 may extend from the top surface 12 to a point just above the outward protrusion 34 where the first surface 30 and second surface 32 intersect. As with the overhang cavity 20, buttress 40 may also be undulated, if desired to enhance shock-absorption capabilities.

Buttress 40 may also be elongated such that it can help properly orient the item being shipped in a shipping container. For example, where the shipping container is a corrugated box, the elongated buttress may extend along a certain length of the corrugated box corner. Thus, when used in conjunction with overhang cavity 20, both the overhang cavity 20 and buttress 40 may ensure proper orientation of the item within the shipping container as well as maintain proper support for the item being shipped.

The amount of protrusion of the buttress 40, however, may be more or less than the protrusion of the bulbous corner 26. Buttress 40 may be sized as necessary, depending on a number of factors, including, but not limited to packaging performance criteria, item delicacy, cost constraints, and the like. In one embodiment, the longer the buttress 40 is, the better the energy dissipation may be away from the overhang edge towards the side surfaces, and the better the buttress 40 itself may be able to absorb energy from impact forces directed to the side edge of the item.

As previously discussed, one of the important factors to account for in sizing buttress 40 is cost. As fiber molded corner protectors are typically very low cost per unit items, the amount of material being used may be reduced if the item being shipped does not need the amount of protection and/or item orientation control afforded by an elongated buttress. For example, though not illustrated, in one embodiment the outward protrusion may extend from a first end of first and second side lands up to the floor of the overhang cavity, in which case the outward protrusion may in effect become a buttress and facilitate energy transfer. However, with such a configuration, the outward protrusion will likely not provide much assistance in product orientation within the shipping container.

Figure 3:
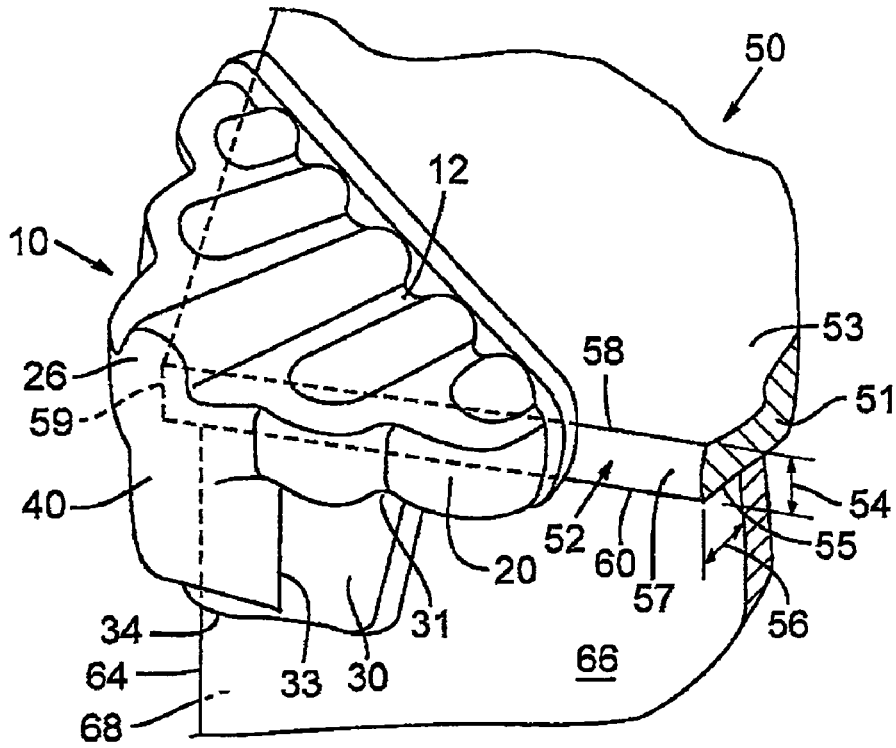
FIG. 3 illustrates a perspective view of an overhang edge corner protector in accordance with an embodiment of the present invention.

FIG. 3 illustrates an enlarged partial perspective view of an overhang edge corner protector in accordance with an embodiment of the present invention, where shipping protector 10 is positioned on a corner of a casegood 50, for example. Casegood 50 may have a top piece 51 having an overhang edge 52 that overhangs the first and second sides 66, 68 of the casegood 50. Overhang edge 52 may have a top overhang edge 58 and a bottom overhang edge 60, an overhang edge face 57 and an overhang edge corner 59.

Top and bottom overhang edges 58, 60, overhang face 57 and overhang edge corner 59 are the areas on an item that tend to be the most delicate and most vulnerable to damage resulting from adverse impacts during shipping, as well as being particularly susceptible to burnishing and/or abrasion during transport. Side edge 64 of casegood 50, defined by the intersection of first and second sides 66, 68 is also susceptible to damage, but since it is somewhat recessed from the overhang edge, side edge 64 may receive less of the shock or impact from a drop, for example. Overhang edge 52 may also have an overhang thickness 54 and an overhang depth 56.

Overhang edge protector 10 may be positioned about corner 59 such that a portion of overhang edge 52 that overhangs both first and second sides 66, 68 is encompassed by overhang cavity 20. First side land 30 may be positioned such that a portion of its surface is in contact with first side 66 of casegood 50. Though not shown, a second side land 32 of overhang edge corner protector 10 may be in partial contact with adjacent second side 68 of casegood 50.

In one embodiment, the contact of first and second side lands 30, 32 may be in contact with first and second sides 66, 68, respectively, such that a standoff distance may be created between the interior walls of overhang cavity 20 and the top and bottom overhang edges 58, 60, overhang face 57, and overhang edge corner 59. This standoff distance, again, allows the overhang edge 52 to generally remain floating, with only certain occasional points of contact with the top overhang edge 58, bottom overhang edge 60, and overhang face 57 occurring during normal shipping rigors. Likewise, bulbous corner 26 may allow overhang edge corner 59 to remain floating. A floating overhang edge not only may help prevent burnishing and/or abrasion of the overhang edges and the overhang corner edge, but may also provide for additional energy absorption should an impact be directed at the overhang edge 52.

In addition to the floating overhang edge 52, the first and second side lands 30, 32 in conjunction with outward protrusion 34 may also urge the overhang edge corner protector 10 to also stand off side edge 64 of casegood 50. This standoff may again help prevent undesirable burnishing and/or abrasion of side edge 64, and may also provide additional energy absorption during impact.

Though in one embodiment the edges of overhang edge 52 may be floating, in other embodiments, depending on the height of the overhang cavity 20, either the underside of top surface 12 or the interior portion of floor 24 may be in contact with the substantially flat surfaces 53, 55 of the top piece 51. It has been found, particularly when using a non-course interior surface, that such contact with the flat surfaces of the top piece does not cause undue abrasion, and is therefore acceptable.

Buttress 40 may be part of overhang edge corner protector 10 and extend substantially the entire length of overhang edge protector 10. Buttress 40 may be integrated with overhang cavity 20 at bulbous corner 26, and coupled to first and second side lands 30, 32 at side transition point 33, and terminate at outward protrusion 34. So configured, if a force is directed at corner 59, for example, buttress 40 may divert energy downwardly along its length and sides into the first and second side lands 30, 32. This energy may then cause the first and second side lands 30, 32 to transfer the energy to first and second sides 66, 68. This not only protects corner 59 from any direct impact, but also diverts energy toward a typically more sturdy part of casegood 50 (i.e., the sides).

Where a force is directed more toward the sides of overhang edge 52, the energy would likewise be transferred to the first and second sides 66, 68 through the first and second side lands 30, 32. In such a case, however, buttress 40 may play a lesser roll in the energy transfer, whereas the energy may be transferred directly from the overhang cavity 20 to the first and second side lands 30, 32 by virtue of their integration at first transition point 31. Also, as previously discussed, where the overhang cavity 20 has an undulating rear wall portion, these undulations will tend to flatten out during impact and therefore absorb some of the impact energy, as well as help distribute energy along more of the length of the overhang cavity and hence a greater portion of side lands 30, 32.

The height and depth of the overhang cavity 20 may be altered as desired. Because overhang edge heights 54 and depths 56 may widely vary depending on the item, it is not necessarily practical from a cost perspective to size the overhang cavity height and depth precisely the same as or just slightly larger than the overhang edge height and depth. Accordingly, for production efficiency and to accommodate a wide variety of overhang edge heights 54 and depths 56, a certain amount of play is acceptable between the surfaces of the overhang edge and the interior surfaces of the overhang cavity. As previously discussed, it may in fact be preferable to have such play in the form of standoff distance to allow the overhang top and bottom edges 58, 60, overhang face 57 and overhang corner 59 to substantially float within overhang cavity 20 to protect the edges from excessive burnishing and/or abrasion.

In one embodiment of the invention, the depth of overhang cavity may be sized within a range of one-eighth of an inch to four inches to accommodate the overhang of many items. Likewise, the height for overhang cavity may be in the range of one-quarter of an inch to three inches. However, the depth and height of the overhang cavity may be varied depending on the actual overhang of the item.

Figure 4:
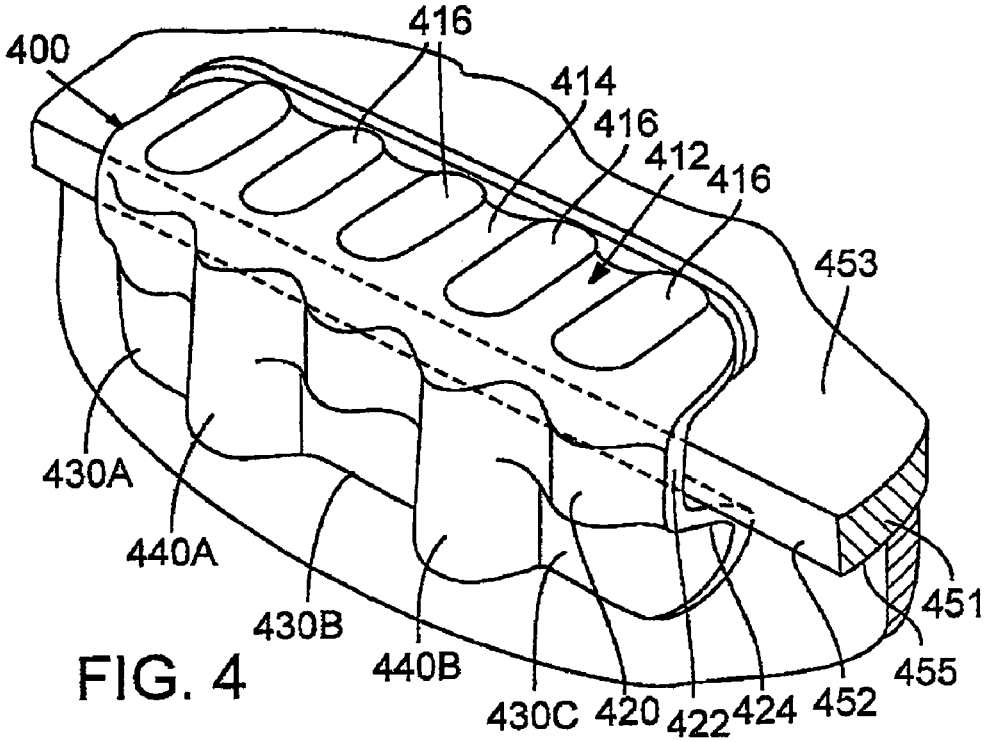
FIG. 4 illustrates a perspective view of an overhang edge protector in accordance with an embodiment of the present invention.

Though the illustrated embodiments merely describe certain preferred embodiments of overhang edge corner protectors in accordance with the present invention, it can be appreciated that numerous modifications and changes may be implemented without departing from the scope of the invention. Additionally, it can be appreciated that embodiments in accordance with the present invention may also be used for overhang edge protection not at the corner, but on the sides. FIG. 4, for example, illustrates a perspective view of a overhang edge shipping protector in accordance with an embodiment of the present invention.

As shown in FIG. 4, an overhang edge protector 400 may be configured to be placed on the side runs of an overhang edge 452 of an item. Overhang edge protector 400 may have a top surface 412 having a plurality of lands 414 and valleys 416. Overhang edge protector 400 may also have an overhang cavity 420 partially defined by the top surface 412, a rear wall 422, and a floor 424. The rear wall portion of overhang cavity 420 may be undulated as described with respect to the overhang edge corner protector in FIGS. 1-3.

Overhang edge protector 400 may also have a series of side lands 430A, 430B, 430C interspersed between a corresponding one or more of buttresses 440A, 440B. Accordingly, when a force is directed at the overhang edge 452 encompassed by the overhang cavity 420, the energy may be dissipated through the buttresses 440A, 440B down into the side lands 430A, 430B, 430C, thereby directing much of the energy away from the overhang edge 452 to the broader side of the item. Further, the one or more buttresses 440A, 440B may also help to maintain proper orientation and resist movement of the item within a shipping container.

As embodiments in accordance with the present invention have been discussed with respect to certain furniture type items, embodiments in accordance with the present invention may work for a wide variety of items and products having an overhang edge. For example, in one embodiment, an overhang edge protector in accordance with the present invention may be inverted and used to protect the feet of chairs, tables and the like that may have a geometry that is not a simple square or rectangular geometry (e.g. a claw foot). Further, though certain orientational identifiers have been used herein (e.g. top, side, downward, etc.), this has only been for purposes of describing one or more embodiments in accordance with the present invention, and are not intended to be limiting in nature. Rather, an overhang edge may be on a side, bottom or anywhere else on an item, and the overhang edge protectors in accordance with embodiments of the present invention may still provide enhanced protection for overhang edges than that afforded by current molded fiber protectors.

As molded fiber products tend to be less expensive, more environmentally friendly, and more workable than other products, such as polystyrene, fabricated corrugated products, etc., embodiments in accordance with the present invention may provide for a shipping protector of increased strength and which is capable of providing enhanced protection for overhang edges than known molded fiber protectors. Though embodiments of the present invention are particularly suited for increasing the strength and performance of molded fiber materials for overhang edges, other materials may be used without departing from the scope of the inventions.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

What is claimed is:

1. An overhang edge corner protector, comprising:

an upper surface configured for engagement with a top surface of a item having an overhang edge and an overhang edge corner, the over hang edge having a height of about one-quarter inch to three inches, and a depth of about one-eighth inch to four inches;

an overhang cavity at least partially defined by the upper surface and a floor that extends towards the item to be engaged, the overhang cavity adapted to encompass at least a portion of the overhang edge and the overhang edge corner, the overhang cavity having a height greater than or equal to a height of the overhang edge;

a first side land and a second side land angularly opposed from one another and adapted to interface with a respective first side and a second side of the item, the first side land and the second side land extending away from the overhang cavity; and an outward protrusion joining the first side land and the second side land such that the overhang edge corner protector may stand off an edge of the item defined by the first side and second side.

2. The overhang edge corner protector of claim 1, wherein the overhang cavity includes a bulbous corner adapted to encompass the overhang edge corner such that the overhang edge corner is not in substantial contact with an inner surface of the bulbous corner.

3. The overhang edge corner protector of claim 2, further comprising an elongated buttress integrated with the bulbous corner and the first and second side surfaces, the buttress extending away from the overhang cavity and adapted to transfer energy from the overhang cavity and bulbous corner to the first and second side lands.

4. The overhang edge corner protector of claim 3, wherein the buttress is sized to urge proper orientation of the overhang edge corner protector within a shipping container.

5. The overhang edge corner protector of claim 3, wherein the buttress extends away from the overhang cavity in a substantially perpendicular manner.

6. The overhang edge corner protector of claim 1, wherein the first and second side lands are adapted to contact the respective first and second sides of the item such that the overhang edge is substantially floating within the overhang cavity.

7. The overhang edge corner protector of claim 1, wherein the top surface has a plurality of lands and valleys.

8. The overhang edge corner protector of claim 1, wherein a portion of the overhang cavity is undulated along a portion of its length.

9. The overhang edge corner protector of claim 1, wherein an interior portion of the overhang edge corner protector is substantially nonabrasive to prevent surface abrasion.

10. The overhang edge corner protector of claim 1, wherein the overhang cavity has an interior height in the range of one-quarter inch to three inches, and an interior depth in the range of one-eighth inch to four inches.

11. The overhang edge corner protector of claim 1, wherein the outward protrusion is an elongated buttress extending away from the overhang cavity and adapted to transfer energy from the overhang cavity to the first and second side lands.

12. An overhang edge shipping protector, comprising:

an upper surface configured for engagement with a top surface of an item having an overhang edge, the over hang edge having a height of about one-quarter inch to three inches, and a depth of about one-eighth inch to four inches;

an overhang cavity at least partially defined by the upper surface, and having a rear wall portion and a floor portion, the overhang cavity configured to encompass at least a portion of the overhang edge, the overhang cavity having a height greater than or equal to a height of the overhang;

at least two side lands adapted to interface with one or more side surfaces of the item, the first side land and the second side land extending away from the overhang cavity; and an elongated buttress positioned between the at least two side lands and extending away from the overhang cavity, the elongated buttress adapted to transfer energy from the overhang cavity to the first and second side lands.

13. The overhang edge shipping protector of claim 12, wherein the elongated buttress is sized to urge proper orientation of the overhang edge shipping protector within a shipping container.

14. The overhang edge shipping protector of claim 12, wherein the buttress extends away from the overhang cavity in a manner that is substantially parallel to the at least two side lands.

15. The overhang edge shipping protector of claim 12, wherein the at least two side lands are adapted to contact the side surface of the item such that the overhang edge is substantially floating within the overhang cavity.

16. The overhang edge shipping protector of claim 12, wherein the top surface has a plurality of lands and valleys.

17. The overhang edge shipping protector of claim 12, wherein a rear portion of the overhang cavity is undulated along a portion of its length.

18. The overhang edge shipping protector of claim 12, wherein an interior portion of the overhang edge corner protector is finished smooth to prevent surface abrasion.

19. The overhang edge corner protector of claim 12, wherein the overhang cavity has a depth greater than or equal to a depth of the overhang edge.

20. The overhang edge shipping protector of claim 12, wherein the overhang edge shipping protector is an overhang edge corner protector and the side lands are generally angularly opposed to one another.

21. A molded fiber overhang edge corner protector, comprising:

an upper surface configured for engagement with a top surface of a item having an overhang edge and an overhang edge corner;

an overhang cavity at least partially defined by the upper surface, a rear wall portion and a floor, the overhang cavity configured to encompass at least a portion of the overhang edge and the overhang edge corner, the overhang cavity having a height greater than or equal to a height of the overhang edge and a depth greater than or equal to a depth of the overhang edge, the rear wall portion being undulated such that a bulbous corner is formed that may encompass the overhang edge;

a first side land and a second side land angularly opposed from one another and adapted to interface with a respective first side and a second side of the item, the first side land and the second side land extending away from the overhang cavity, the first and second side lands are configured to contact the respective first and second sides of the item such that the overhang edge is substantially floating within the overhang cavity;

an outward protrusion joining the first side land and the second side land such that the overhang edge corner protector may stand off an edge of the item defined by the first side and second side; and an elongated buttress integrated with the bulbous corner and the first and second side lands, the buttress extending away from the overhang cavity and adapted to transfer energy from the overhang cavity and bulbous corner to the first and second side lands.

22. An overhang edge corner protector, comprising:

an upper surface configured for engagement with a top surface of a item having an overhang edge of a determined height and an overhang edge corner;

an overhang cavity at least partially defined by the upper surface and a floor, the overhang cavity adapted to encompass at least a portion of the overhang edge and the overhang edge corner, the overhang cavity having a height greater than or equal to the determined height of the overhang edge; and a first side land and a second side land angularly opposed from one another and adapted to interface with a respective first side and a second side of the item, the first side land and the second side land extending away from the overhang cavity;

wherein the overhang edge corner protector includes an outward protrusion joining the first side land and the second side lands such that a portion of the overhang edge corner protector may stand off at least a portion of an edge of the item defined by the first side and second side.

23. The overhang edge corner protector of claim 22, wherein the outward protrusion is an elongated buttress extending away from the overhang cavity and adapted to transfer energy from the overhang cavity to the first and second side lands.

24. An overhang edge corner protector, comprising:

an upper surface configured for engagement with a top surface of a item having an overhang edge and an overhang edge corner, the over hang edge having a height of about one-quarter inch to three inches, and a depth of about one-eighth inch to four inches;

an overhang cavity at least partially defined by the upper surface and a floor, the overhang cavity and adapted to encompass at least a portion of the overhang edge and the overhang edge corner, the overhang cavity having a height greater than or equal to a height of the overhang edge;

a first side land and a second side land angularly opposed from one another and adapted to interface with a respective first side and a second side of the item, the first side land and the second side land extending away from the overhang cavity; and an outward protrusion joining the first side land and the second side land such that a portion of the overhang edge corner protector may stand off an edge of the item defined by the first side and second side.

25. The overhang edge corner protector of claim 24, wherein the outward protrusion is an elongated buttress extending away from the overhang cavity and adapted to transfer energy from the overhang cavity to the first and second side lands.

26. The overhang edge corner protector of claim 24, wherein the overhang cavity has a depth greater than or equal to a depth of the overhang edge.

* * * * *